US011617390B2

(12) United States Patent
Tidwell et al.

(10) Patent No.: US 11,617,390 B2
(45) Date of Patent: Apr. 4, 2023

(54) CHILD RESISTANT PRE-ROLL CASE AND RELATED METHODS

(71) Applicants: Justin Tidwell, Brea, CA (US); William Tidwell, Brea, CA (US)

(72) Inventors: Justin Tidwell, Brea, CA (US); William Tidwell, Brea, CA (US)

( * ) Notice: Subject to any disclaimer, the term of this patent is extended or adjusted under 35 U.S.C. 154(b) by 434 days.

(21) Appl. No.: 16/734,281

(22) Filed: Jan. 3, 2020

(65) Prior Publication Data

US 2021/0186094 A1 Jun. 24, 2021

Related U.S. Application Data

(63) Continuation-in-part of application No. 29/717,611, filed on Dec. 18, 2019.

(51) Int. Cl.

| | |
|---|---|
| ***A24F 15/12*** | (2006.01) |
| ***B65D 85/10*** | (2006.01) |
| ***B65D 25/04*** | (2006.01) |
| ***B65D 43/16*** | (2006.01) |
| ***A24F 15/01*** | (2020.01) |
| ***B65D 43/22*** | (2006.01) |

(52) U.S. Cl.

CPC ..... *A24F 15/12* (2013.01); *A24F 15/01* (2020.01); *B65D 25/04* (2013.01); *B65D 43/16* (2013.01); *B65D 43/22* (2013.01); *B65D 85/10* (2013.01); *B65D 2215/02* (2013.01)

(58) Field of Classification Search

CPC ..... A24F 15/20; A24F 15/00; A24F 15/02; A24F 15/18; B65D 43/16; B65D 43/161; B65D 43/22; B65D 25/04; B65D 85/10; B65D 85/12

See application file for complete search history.

(56) References Cited

U.S. PATENT DOCUMENTS

| | | | | |
|---|---|---|---|---|
| 7,124,883 | B1 * | 10/2006 | Thomas | B65D 85/10 206/256 |
| 7,537,110 | B2 * | 5/2009 | Kutsch | B65D 83/04 206/39 |
| 8,602,210 | B2 * | 12/2013 | Milner | A24F 15/12 206/242 |
| 10,005,588 | B2 * | 6/2018 | Kanbar | A24F 15/12 |
| 10,414,553 | B2 * | 9/2019 | Ziering | B65D 25/04 |
| 2017/0334605 | A1 * | 11/2017 | Murphy | A24F 40/40 |

* cited by examiner

*Primary Examiner* — Javier A Pagan

(74) *Attorney, Agent, or Firm* — Buche & Associates, P.C.; John K. Buche; Bryce A. Johnson

(57) ABSTRACT

Disclosed is a child resistant pre-roll case for storing pre-rolls, lighters, and other accessories or personal items.

5 Claims, 12 Drawing Sheets

CHILD RESISTANT PRE-ROLL CASE AND RELATED METHODS

CROSS-REFERENCE TO RELATED APPLICATIONS

This application is a continuation-in-part of U.S. Design patent application No. 29/717,611, filed Dec. 18, 2019, entitled Pre-Roll Case.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The disclosed subject matter is in the field of child resistant cases for carrying pre-rolls, apparatuses, and accessories for smoking.

Background of the Invention

One method of consuming cannabis is through smoking "joints" or "blunts," which are typically hand rolled cigarettes or cigars. However, rolling or preparing your own "joints" or "blunts" can be difficult and time-consuming. Accordingly, users can acquire "pre-rolls," which are essentially "joints" or "blunts" that have been prepared ahead of time for a user, so that a user does not have to go through the effort of preparing his or her own "joint" or "blunt." Often times, storing "joints," "blunts," or "pre-rolls" (collectively "pre-rolls") is difficult because they can be easily bend, tear, or fall apart, since they are often wrapped with a paper or leaf type wrap. Moreover, these pre-rolls may exhibit an odor because of its contents or may get wet based on the external environment if not stored properly.

Accordingly, it is beneficial to have a rigid storage unit to store pre-rolls so that they are not structurally compromised when carrying them. It is also beneficial to have a storage unit that does not allow water, moisture, or fluid to come into contact with the pre-rolls and that keeps odors within the storage unit. Additionally, as more and more states are legalizing the sale and use of both medical and recreational cannabis, there is more of a need, and in some states a requirement, to have child resistant packaging for items that store cannabis.

Thus, a need exits for a child resistant case for carrying pre-rolls that maintains the structural integrity of a pre-roll, keeps water from coming into contact with the pre-rolls, contains odor within a storage unit, and prevents children from accessing the cannabis within a storage unit.

SUMMARY OF THE INVENTION

In view of the foregoing, an object of this specification is to disclose a pre-roll case that is child resistant.

It is another object of this specification to disclose a pre-roll case that has storage for a lighter, smoking accessory, or personal item.

It is another object of this specification to disclose a pre-roll case that does not allow odor to escape the case.

It is another object to this specification to disclose a pre-roll case that is water resistant.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Figure 1:
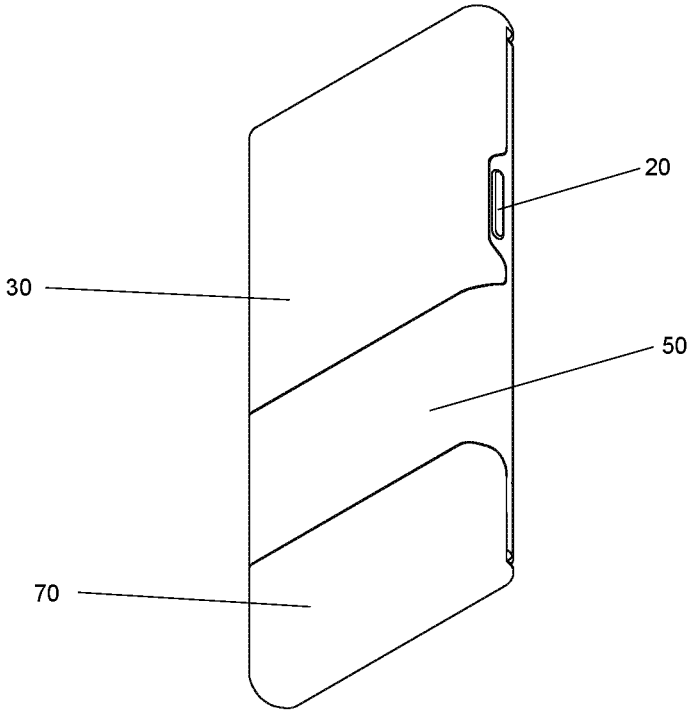
FIG. 1 is a perspective view of one embodiment of the pre-roll case in a closed configuration.
Figure 2:
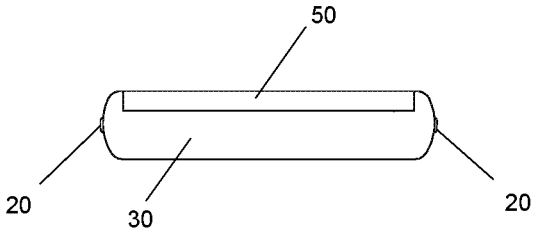
FIG. 2 is a top view of one embodiment of the pre-roll case in an closed configuration.
Figure 3:
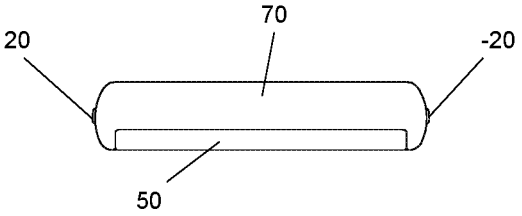
FIG. 3 is a bottom view of one embodiment of the pre-roll case in a closed configuration.
Figure 4:
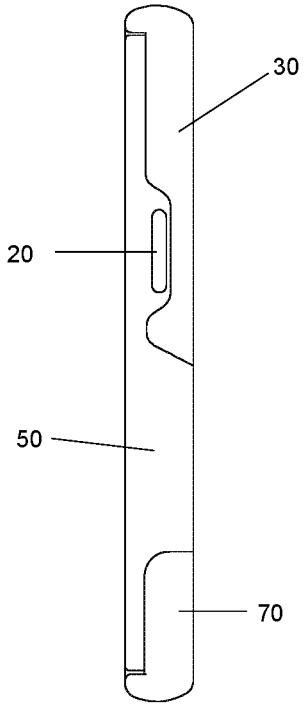
FIG. 4 is a left side view of one embodiment of the pre-roll case in a closed configuration.
Figure 5:
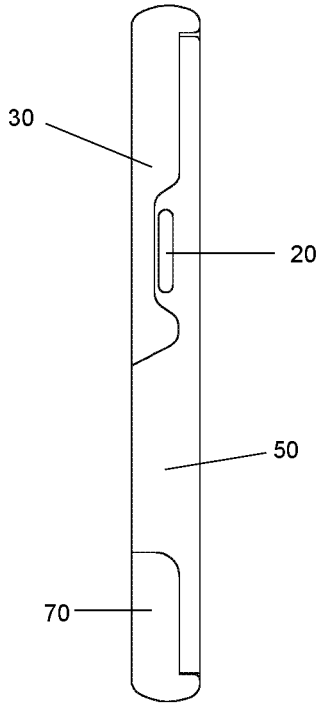
FIG. 5 is a right side view of one embodiment of the pre-roll case in a closed configuration.
Figure 6:
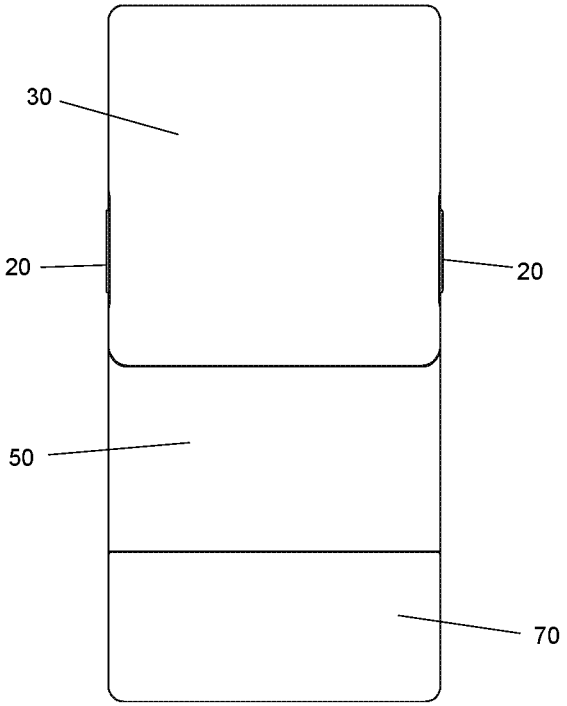
FIG. 6 is a front view of one embodiment of the pre-roll case in a closed configuration.
Figure 7:
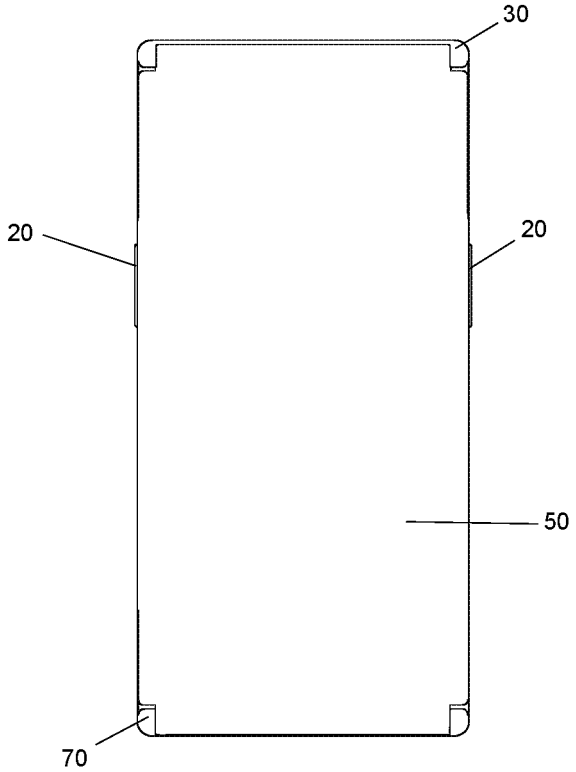
FIG. 7 is a back view of one embodiment of the pre-roll case in a closed configuration.

Disclosed is a child resistant pre-roll case. FIG. 1 is a perspective view of one embodiment of the pre-roll case in a closed configuration; FIG. 2 is a top view of one embodiment of the pre-roll case in a closed configuration; FIG. 3 is a bottom view of one embodiment of the pre-roll case in a closed configuration; FIG. 4 is a left side view of one embodiment of the pre-roll case in a closed configuration; FIG. 5 is a right side view of one embodiment of the pre-roll case in a closed configuration; FIG. 6 is a front view of one embodiment of the pre-roll case in a closed configuration; and FIG. 7 is a back view of one embodiment of the pre-roll case in a closed configuration. Referring to FIGS. 1-7, when in a closed configuration, the pre-roll case is defined by a body 50, a first cover 30, a second cover 70 and two releases 20, that protrude beyond each side of the first cover 30. The releases 20 are housed on the sides of the first compartment 10 (See FIG. 8) and are used to keep the first cover 30 securely closed when the pre-roll case is in a closed configuration. As discussed below, the releases 20 are a feature of child resistance to opening the case.

Figure 8:
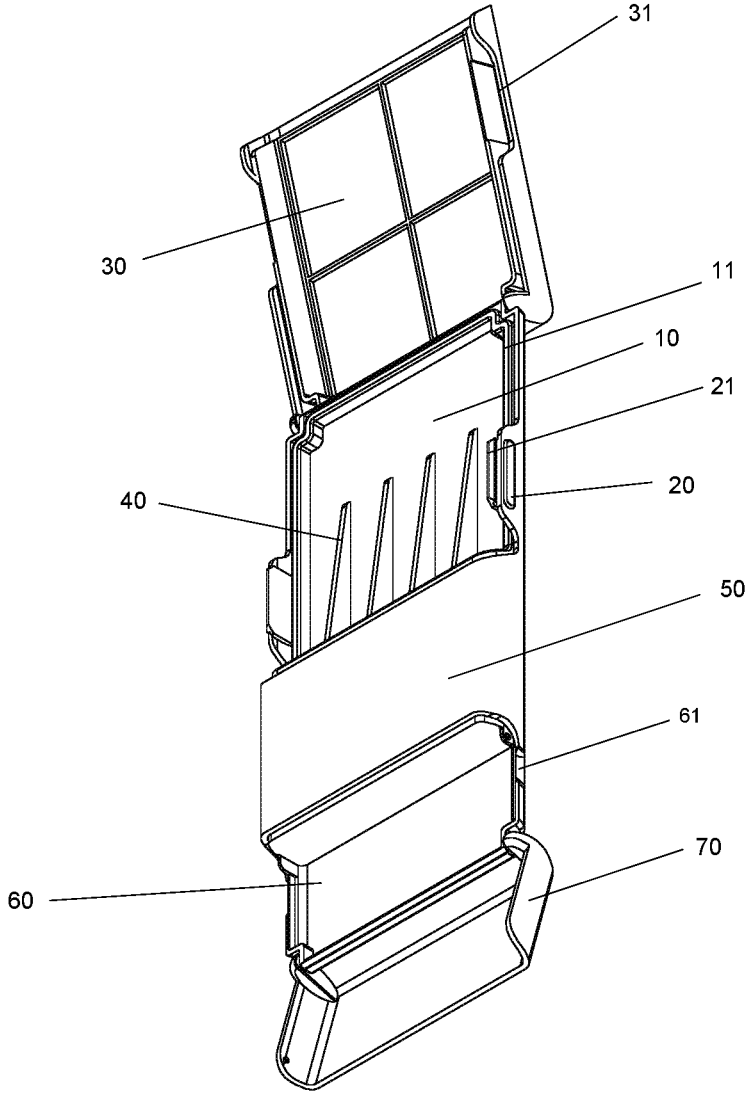
FIG. 8 is a perspective view of one embodiment of the pre-roll case in a closed configuration.
Figure 9:
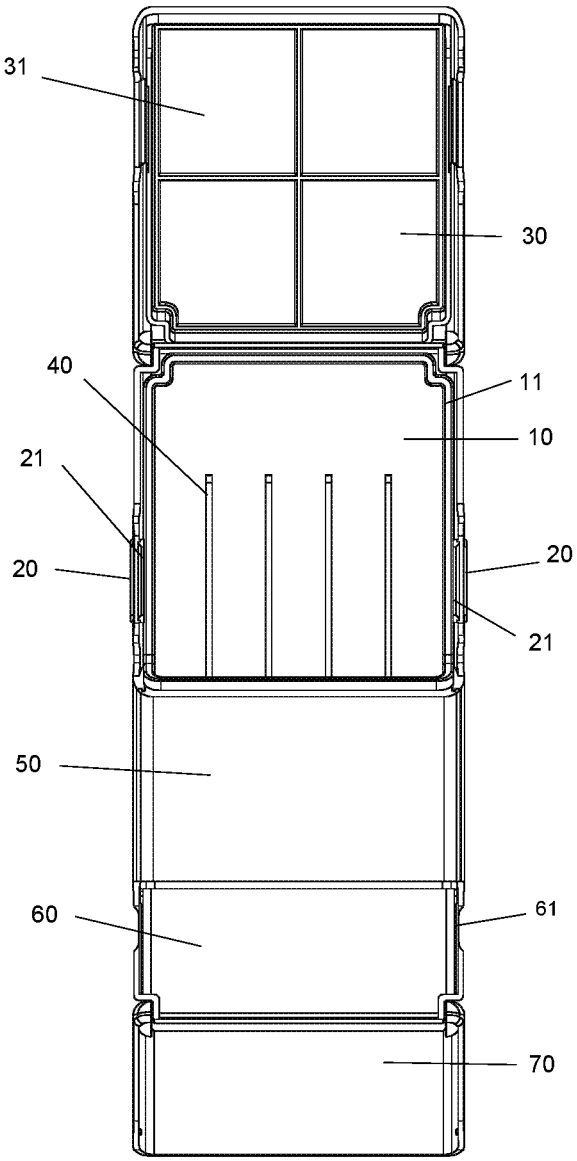
FIG. 9 is a front view of one embodiment of the pre-roll case in an open configuration.
Figure 10:
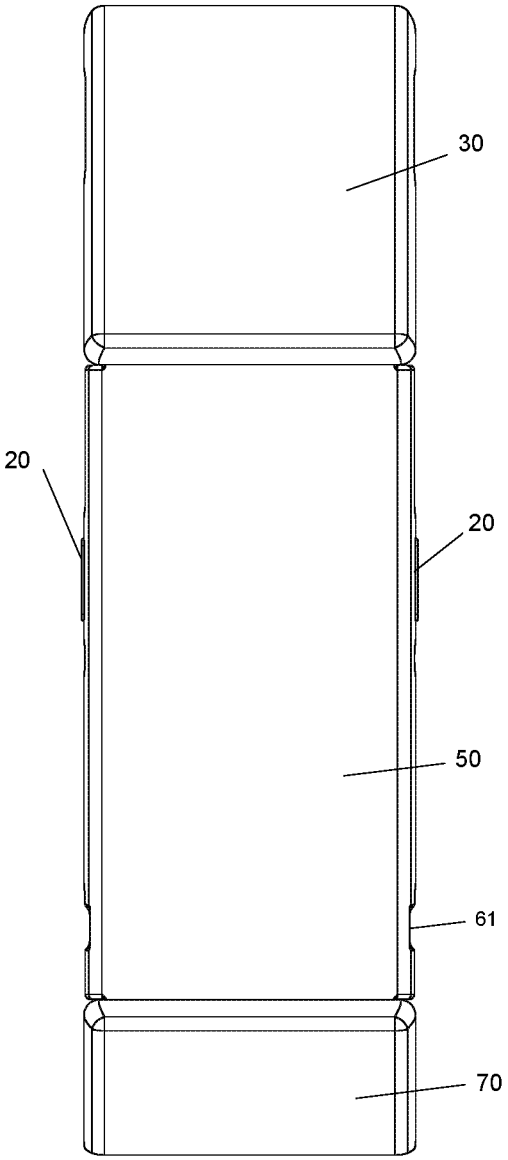
FIG. 10 is a back view of one embodiment of the pre-roll case in an open configuration.

FIG. 8 is a perspective view of one embodiment of the pre-roll case in an open configuration; FIG. 9 is a front view of one embodiment of the pre-roll case in an open configuration; and FIG. 10 is a back view of one embodiment of the pre-roll case in an open configuration. Referring to FIGS. 8-10, in a preferred embodiment, the pre-roll case is comprised of a first compartment 10, a gasket 11, releases 20, tongues 21, a first cover 30, grooves 31, pre-roll dividers 40 within the first compartment 10, a body 50, a second compartment 60, and a cover 70. In a preferred embodiment, the pre-roll case is defined by a first compartment 10 that has a first cover 30 that is pivotally or hingedly connected/affixed at the top of the first compartment 10, wherein the first cover 30 opens like a clamshell to reveal the first compartment 10 as it rotates around the top of the of the first compartment 10. Still referring to FIG. 1, the first compartment 10 has two releases 20 that protrude from each side of the first compartment 10. Each release 20 interfaces with and controls a tongue 21 that engages with groove 31 in the first cover 30 when the first cover 30 is closed to form a snap-fit connection (see FIG. 11).

Still referring to FIGS. 8-10, in a preferred embodiment, the pre-roll case is also defined by a second compartment 60 that is preferably located at the bottom portion of the pre-roll case. The second compartment 60 also has a second cover 70 that is attached to the bottom of the second compartment 60, wherein the second cover 70 opens like a clamshell and rotates around the bottom of the second compartment 60 to cover and reveal the second compartment 60. The second cover 70 may be attached to the second compartment 60 in a hinge type attachment.

Referring to FIGS. 8 and 9, the first compartment 10 features at least 1 pre-roll divider 40. In a preferred embodiment, there are four pre-roll dividers 40, which allows for five pre-rolls to be stored within the first compartment 10. In alternative embodiments, there may be one pre-roll divider 40 or multiple pre-roll dividers 40. In a preferred embodiment, the first compartment 10 extends into the body 50, wherein, pre-rolls that are stored in the first compartment 10 are supported by the body 50 and are prevented from easily falling out of the first compartment 10.

Still referring to FIGS. 8 and 9, in a preferred embodiment, the first compartment 10 features a gasket 11 that is located around the perimeter of the first compartment 10. The gasket 11 forms an air-tight seal that keeps odors inside of the first compartment 10, when in a closed configuration. The gasket 11 also suitably forms a fluid-resistant seal that operates to keep moisture and other fluids out of the first compartment 10, when in a closed configuration. The gasket 11 may be formed of a silicone or rubber material.

Figure 11:
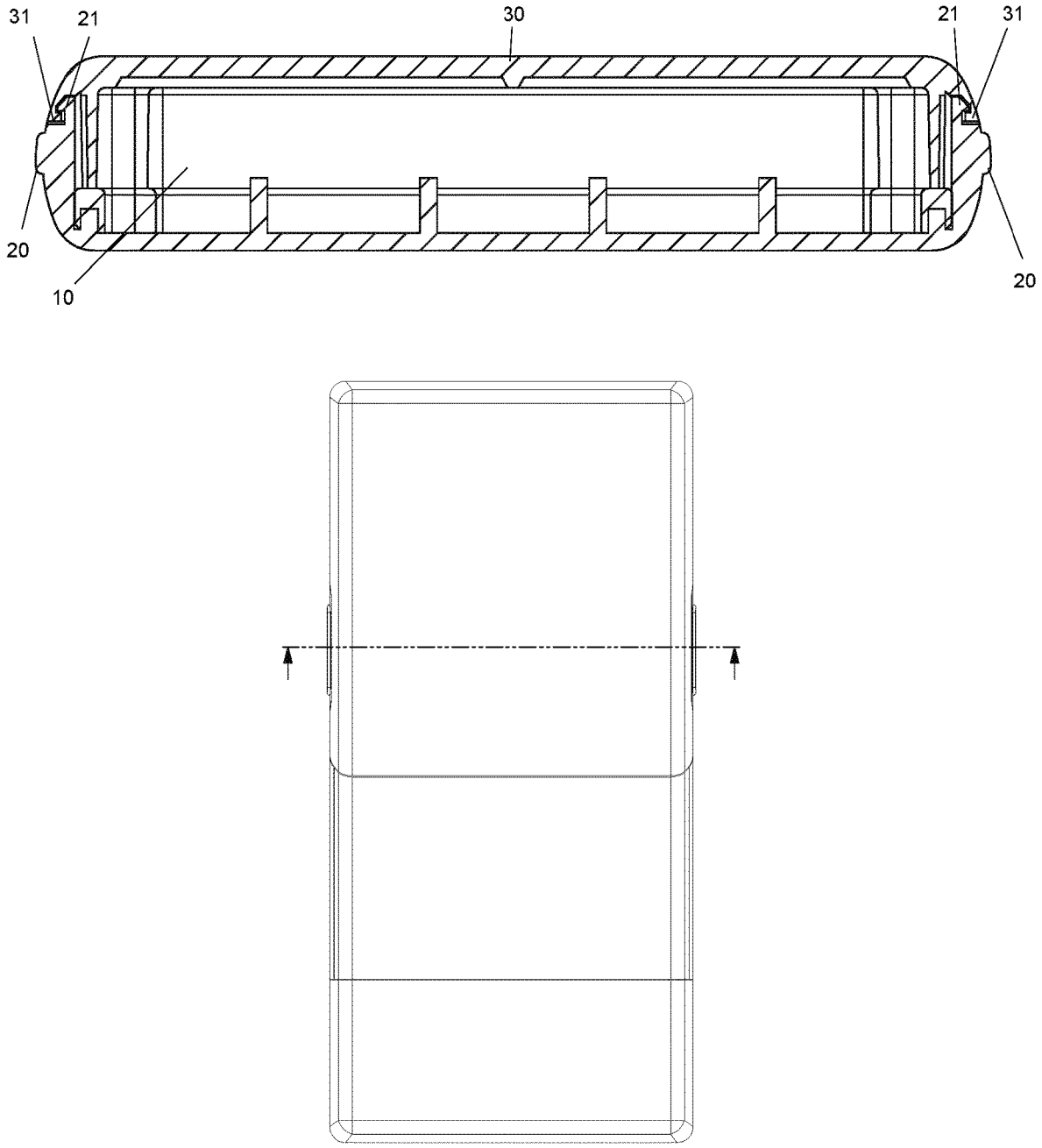
FIG. 11 is a cross-sectional view of one embodiment of the first compartment of the pre-roll case in a closed configuration.

FIG. 11 is a cross-sectional view of the first compartment 10 of one embodiment of the pre-roll case in a closed configuration. Referring to FIG. 11, the first compartment 10 has a release 20 located on each side of the first compartment 10. Each release 20 controls a tongue 21, which is located above the release 20. Each tongue 21 engages with a groove 31 on the first cover 30 to form a snap-fit connection and securely close the first cover 30 over the first compartment 10. When a user presses the release 20 inward, the tongue 21 moves inward and disengages from the groove 31, which allows the first cover 30 to be opened. This action is difficult for a child to accomplish and, as a result, contributes to child resistant operation.

Figure 12:
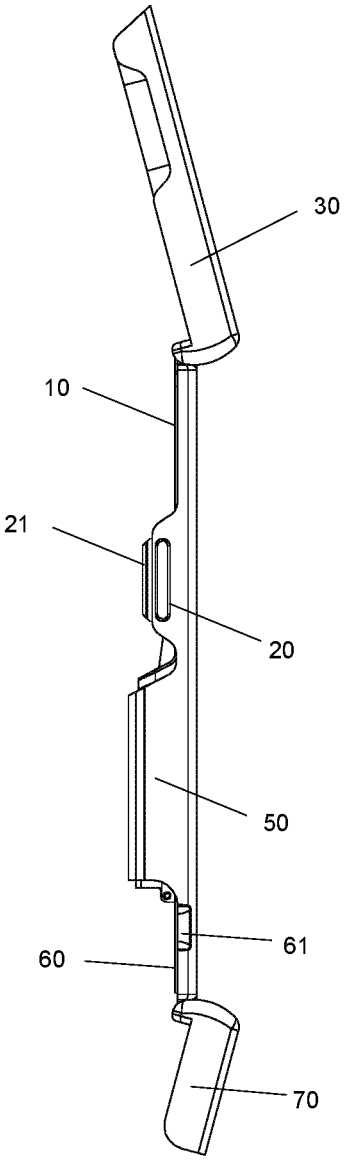
FIG. 12 is a right side view of one embodiment of the pre-roll case in an open configuration.
Figure 13:
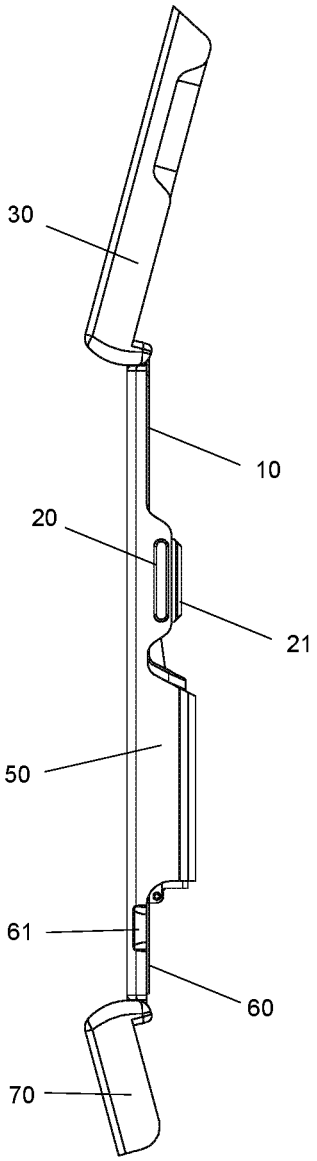
FIG. 13 is a left side view of one embodiment of the pre-roll case in an open configuration.
Figure 14:
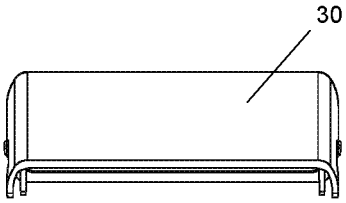
FIG. 14 is a top view of one embodiment of the pre-roll case in an open configuration.
Figure 15:
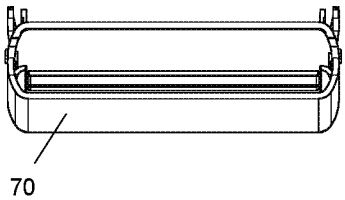
FIG. 15 is a bottom view of one embodiment of the pre-roll case in an open configuration.

FIG. 12 is a right side view of one embodiment of the pre-roll case in an open configuration; FIG. 13 is a left side view of one embodiment of the pre-roll case in an open configuration; FIG. 14 is a top view of one embodiment of the pre-roll case in an open configuration; and, FIG. 15 is a bottom view of one embodiment of the pre-roll case in an open configuration. Referring to FIGS. 12-15, in a preferred embodiment, the second compartment 60 has a notch 61, which allows a user to easily access the side of the second cover 70, when in a closed configuration, and lift the second cover 70 up to reveal the second compartment 60. The second compartment 60 may be used to hold a lighter, accessory, or personal item.

In use, a user may store pre-rolls by: (i) obtaining a pre-roll case; (ii) placing a thumb or finger on one release 20 and another thumb or finger on the other release 20, wherein there is a thumb or finger on each release 20 on each side of the pre-roll case; (iii) simultaneously pressing the releases 20, wherein the releases 20 go inward and disengages the respective tongues 21 from the grooves 31 in the first cover 30; (iv) lifting the first cover 30 up to reveal the first compartment 10; (v) placing at least one pre-roll into a slot between pre-roll dividers 40 or between a pre-roll divider 40 and the side of the first compartment 10; and, (vi) closing the first cover 30 over the first compartment 10 until the tongues 21 engage with the grooves 31, to form a secure child resistant closure. A user may also store a lighter or other accessory or personal item in the second compartment 60 by: (i) placing a finger or object in the notch 61 on each or either side of the second compartment 60; (ii) lifting the second cover 70 to expose the second compartment 60; (iii) placing an object in the second compartment 60; (iv) closing the second cover 70 over the second compartment 60, wherein the object is securely stored in the second compartment 60.

In an alternative embodiment, the second compartment 60 may also feature releases and tongues and the second cover 70 may feature grooves, wherein the second compartment 60 and second cover 70 may be securely closed by a snap fit connection in the same manner as the first compartment 10 and first cover 30.

In a one embodiment, the pre-roll case of FIGS. 1-15 is 130-150 mm in height, 65-70 mm in width, and 10-18 mm in depth. In a preferred embodiment, the pre-roll case of FIGS. 1-15 is 140 mm in height, 68 mm in width, and 14 mm in depth.

Figure 16:
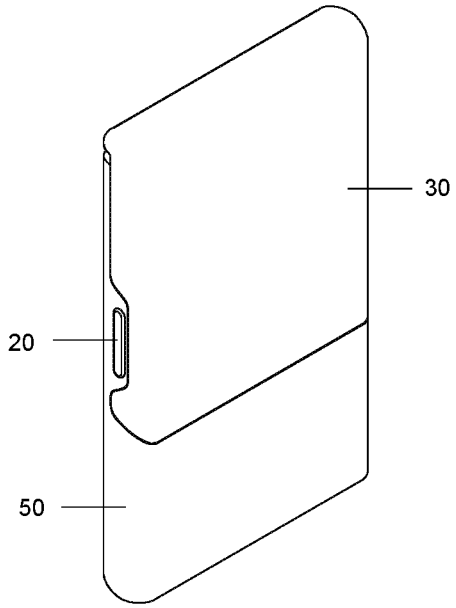
FIG. 16 is a perspective view of an alternative embodiment of the pre-roll case in an open configuration.
Figure 17:
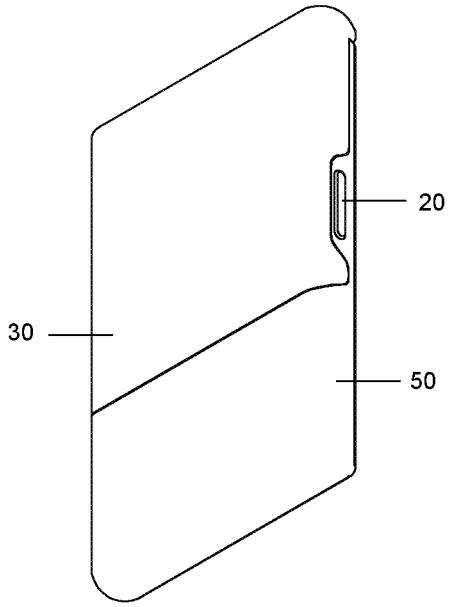
FIG. 17 is a perspective view of an alternative embodiment of the pre-roll case in an open configuration.
Figure 18:
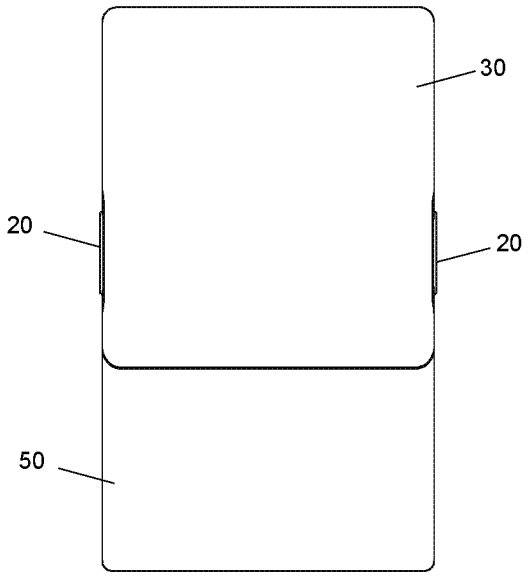
FIG. 18 is a front view of an alternative embodiment of the pre-roll case in a closed configuration.
Figure 19:
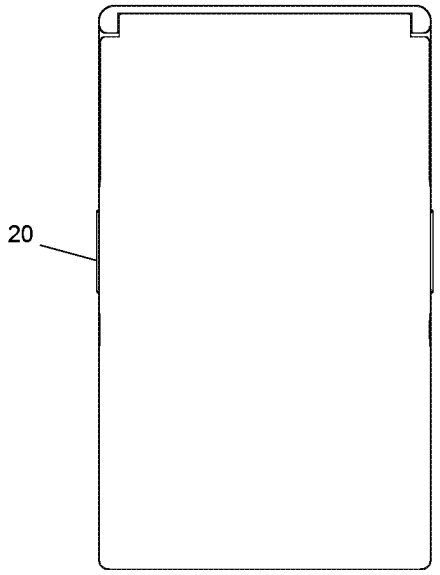
FIG. 19 is a back view of an alternative embodiment of the pre-roll case in an open configuration.
Figure 20:
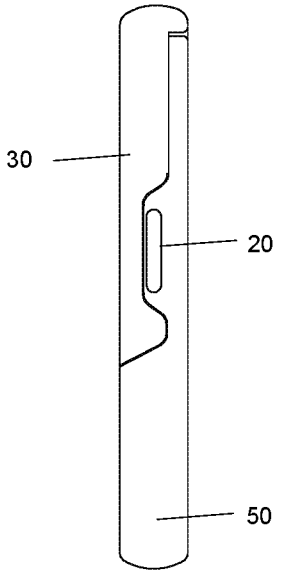
FIG. 20 is a right side view of an alternative embodiment of the pre-roll case in a closed configuration.
Figure 21:
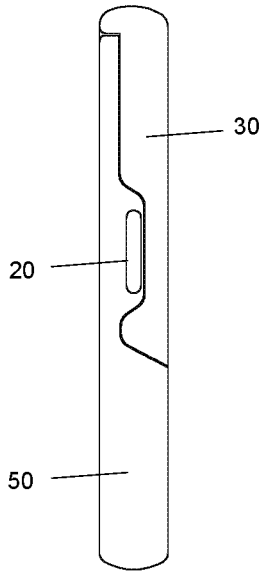
FIG. 21 is a left side view of an alternative embodiment of the pre-roll case in a closed configuration.
Figure 22:
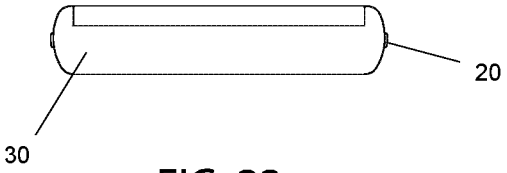
FIG. 22 is a top view of an alternative embodiment of the pre-roll case in a closed configuration.
Figure 23:
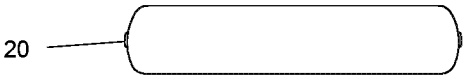
FIG. 23 is a bottom view of an alternative embodiment of the pre-roll case in a closed configuration.

FIG. 16 is a perspective view of one embodiment of the pre-roll case; FIG. 17 is a perspective view of one embodiment of the pre-roll case in a closed configuration; FIG. 18 is a front view of one embodiment of the pre-roll case in a closed configuration; FIG. 19 is a back view of one embodiment of the pre-roll case in a closed configuration; FIG. 20 is a right side view of one embodiment of the pre-roll case in a closed configuration; FIG. 21 is a left side view of one embodiment of the pre-roll case in a closed configuration; FIG. 22 is a top view of one embodiment of the pre-roll case in a closed configuration; and, FIG. 23 is a bottom view of one embodiment of the pre-roll case in a closed configuration.

Referring to FIGS. 16-23, in an alternative embodiment the pre-roll case, the pre-roll case is defined by a first cover 30, releases 20, tongues 21, grooves 31, and a body 50.

Figure 24:
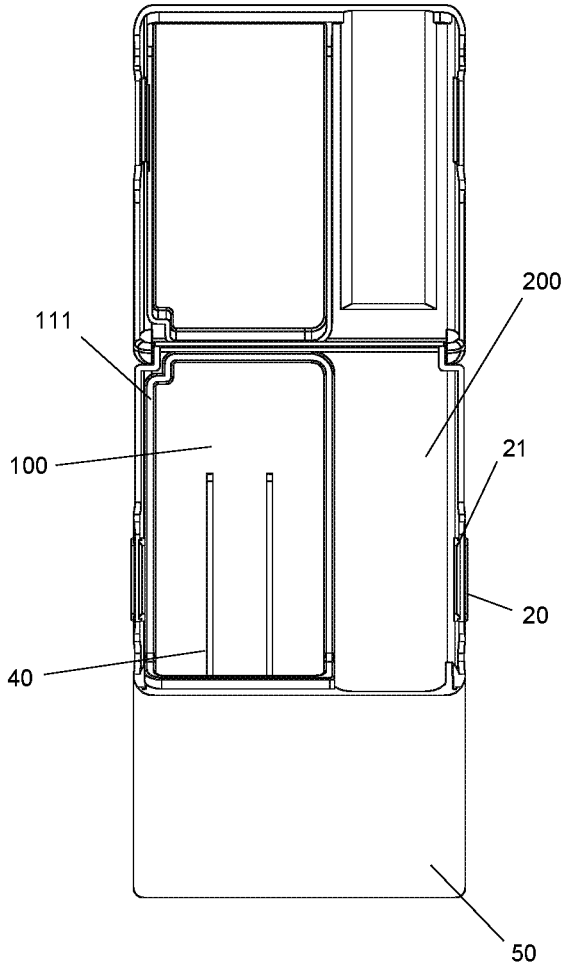
FIG. 24 is a front view of an alternative embodiment of the pre-roll case in an open configuration.
Figure 25:
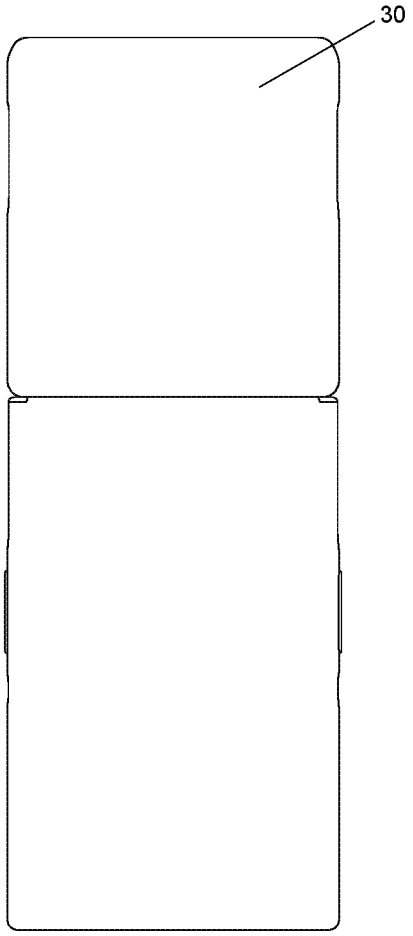
FIG. 25 is a back view of an alternative embodiment of the pre-roll case in an open configuration; and, FIG. 26 is a right side view of an alternative embodiment of the pre-roll case in an open configuration.
Figure 26:
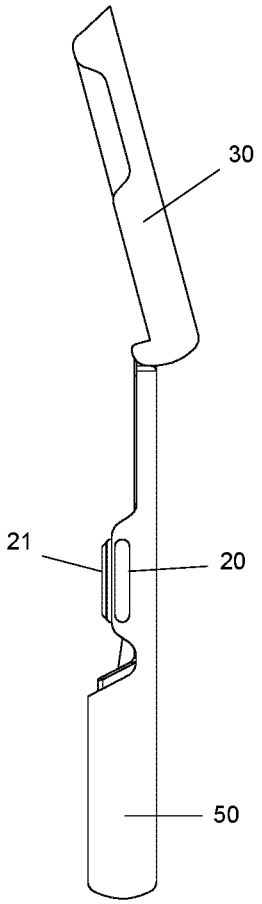
Figure 27:
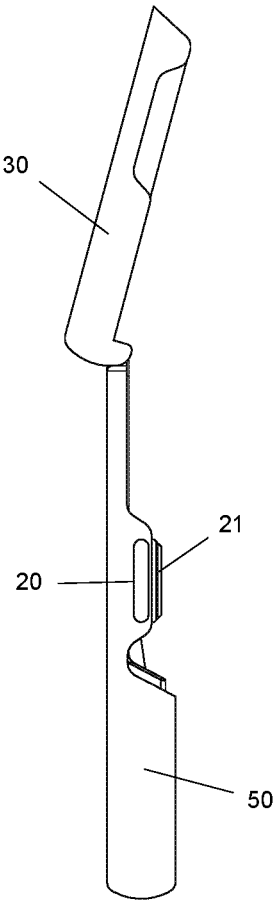
FIG. 27 is a left side view of an alternative embodiment of the pre-roll case in an open configuration.
Figure 28:
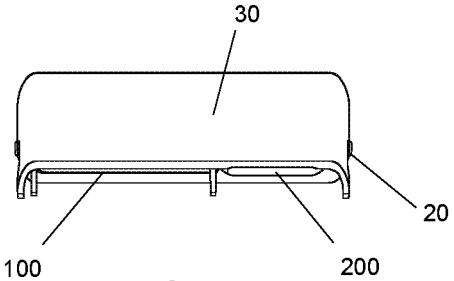
FIG. 28 is a top view of an alternative embodiment of the pre-roll case in an open configuration.
Figure 29:
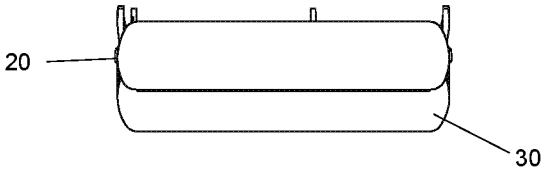
FIG. 29 is a bottom view of an alternative embodiment of the pre-roll case in an open configuration.
Figure 30:
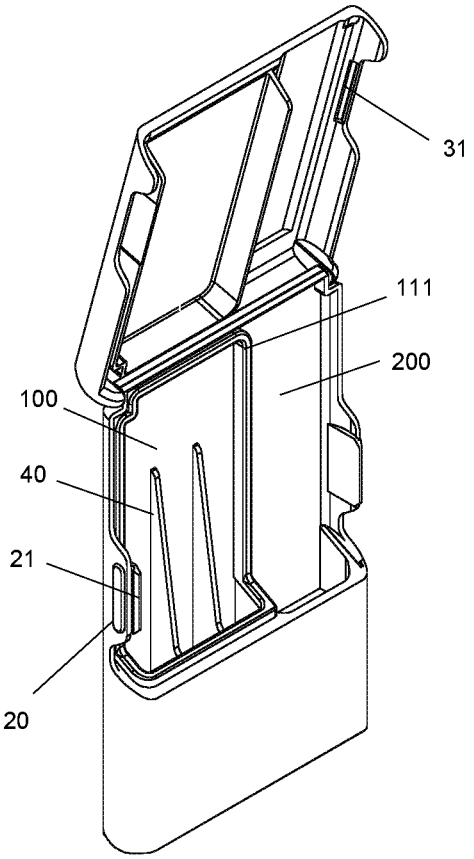
FIG. 30 is a perspective view of an alternative embodiment of the pre-roll case in an open configuration.
Figure 31:
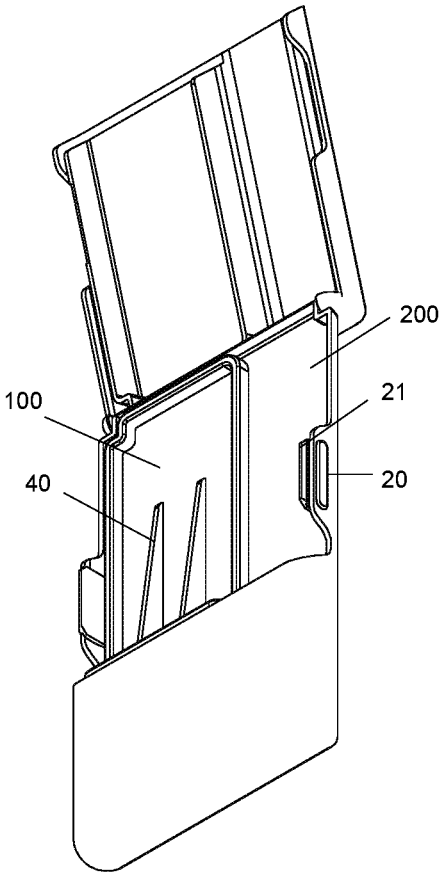
FIG. 31 is a perspective view of an alternative embodiment of the pre-roll case in an open configuration.

FIG. 24 is a front view of one embodiment of the pre-roll case in an open configuration; FIG. 25 is a back view of one embodiment of the pre-roll case in an open configuration; FIG. 26 is a right side view of one embodiment of the pre-roll case in an open configuration; FIG. 27 is a left side view of one embodiment of the pre-roll case in an open configuration; FIG. 28 is a top view of one embodiment of the pre-roll case in an open configuration; FIG. 29 is a bottom view of one embodiment of the pre-roll case in an open configuration; FIG. 30 is a perspective view of one embodiment of the pre-roll case in an open configuration; and, FIG. 31 is a perspective view of one embodiment of the pre-roll case in an open configuration.

Referring to FIG. 24, an alternative embodiment of the pre-roll case is defined by a first compartment 10 that is separated into a primary storage unit 100 and a secondary storage unit 200. In one embodiment, the primary storage unit 100 features a gasket 111 and at least one divider 40. The primary storage unit 100 may be used to store pre-rolls. In one embodiment, the primary storage unit 100 may have two pre-roll dividers 40, allowing a user to store three pre-rolls. The secondary storage unit 200 may be used to store a lighter, accessory, or personal item. Still referring to FIG. 24, the first compartment 10, as with FIGS. 8-11, features releases 20, tongues 21, a first cover 30, and, grooves 31, wherein, the tongues 21 and grooves 31 engage and disengage with one another when the releases 20 are pressed to allow the first cover 30 to open and securely close over the first compartment 10. As with earlier embodiments, these components can contribute to child resistant opening of the case.

Figure 32:
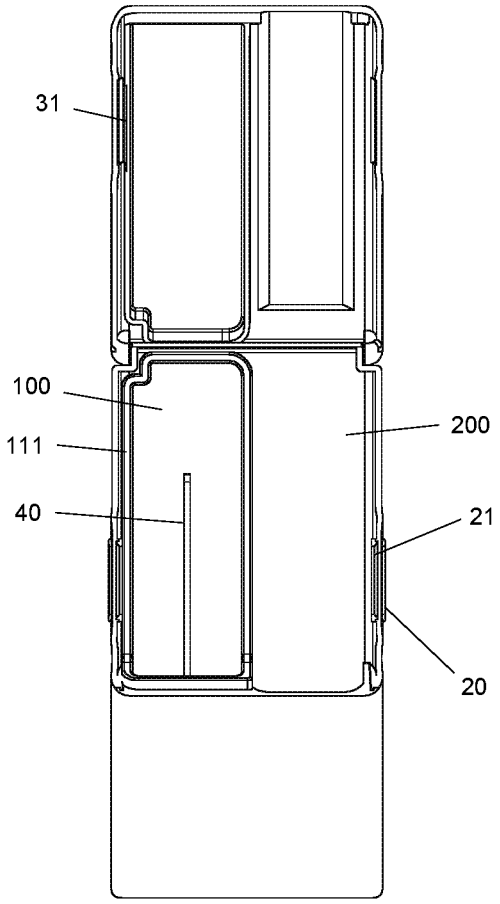
FIG. 32 is a front view of an alternative embodiment of the pre-roll case in an open configuration.
Figure 33:
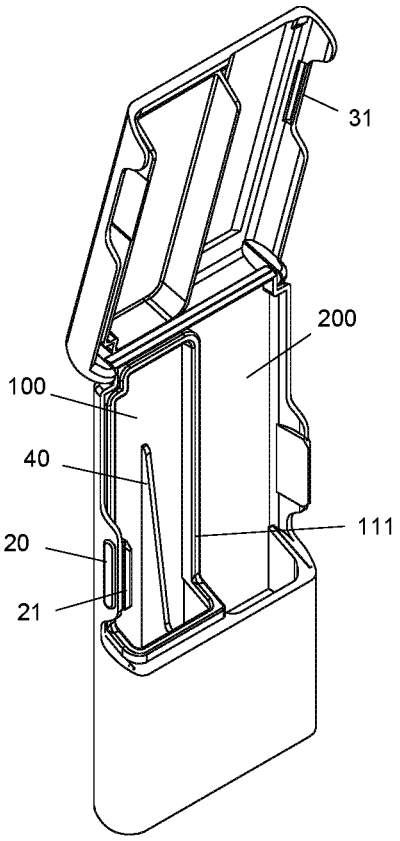
FIG. 33 is a perspective view of an alternative embodiment of the pre-roll case in an open configuration.

FIG. 32 is a front view of an alternative embodiment of the pre-roll case in an open configuration and FIG. 33 is a perspective view of an alternative embodiment of the pre-roll case in an open configuration. Referring to FIGS. 32 and 33, in an alternative embodiment, the primary storage unit 100 may feature one pre-roll divider 40, which allows a user to store two pre-rolls.

In use, a user may store pre-rolls, accessories, or personal items in the alternative embodiments of FIGS. 16-33 by: (i) obtaining a pre-roll case; (ii) placing a thumb or finger on one release 20 and another thumb or finger on the other release 20, wherein there is a thumb or finger on each release 20 on each side of the pre-roll case; (iii) simultaneously pressing the releases 20, wherein the releases 20 go inward and disengages the respective tongues 21 from the grooves 31 in the first cover 30; (iv) lifting the first cover 30 up to reveal the first compartment 10 that features a primary unit 100 and secondary unit 200; (v) placing at least one pre-roll into a slot between pre-roll dividers 40 or between a pre-roll divider 40 and the side of the primary unit 100; (vi) placing a lighter, accessory, or object in the second unit 200; and, (vi) closing the first cover 30 until the tongues 21 engage with the grooves 31, to form a secure child resistant closure.

In a preferred embodiment, the pre-roll case of FIGS. 16-33 may be in a range of 70-150 mm in height, 30-70 mm in width, and 10-18 mm in depth.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus, the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. The method of storing a pre-roll comprising:

obtaining a pre-roll case comprising a body (50), a first compartment (10) located within the body (50) with a release (20) on each side of the first compartment (10), wherein a tongue (21) interfaces with each release 20, a first cover 30 wherein the interior surface features two crossbars, wherein the first cover (30) is hingedly affixed to a top of the first compartment (10) with two hinges, whereby the first cover (30) opens over the first compartment (10), wherein the first compartment 10 features four pre-roll dividers (40) such that the body's interior and the first compartment (50) are divided into five sections by the four pre-roll dividers (40), and, one groove (31) located on each side of the first cover (30), whereby each groove (31) engages with each tongue (21) when the first cover (30) is securely closed over the first compartment (10);

pressing each release (20) inward simultaneously;

lifting the first cover (30);

placing a pre-roll in the first compartment (10) between one of the four pre-roll dividers (40); and, closing the first cover (30) over the first compartment (10); wherein the grooves (31) on the first cover (30) engages with the tongues (21) on the first compartment (10).

2. The method of claim 1, wherein a perimeter of the first compartment (10) features a silicone gasket (11).

3. The method of claim 1, wherein the body (50) also features a second compartment (60) located at a bottom of the body (50).

4. The method of claim 3, wherein the second compartment (60) has a second cover (70) that is hingedly affixed to the bottom of the second compartment (60) with two hinges, whereby the second cover (70) opens in a clam-like fashion over the second compartment (60).

5. The method of claim 4, wherein the second compartment (60) features two notches (61), with one on each side of the second compartment (60), whereby a user can place a finger or object in one of the notches (61) to lift the second cover (70).

* * * * *